United States Patent [19]

Schippers et al.

[11] Patent Number: 4,646,983

[45] Date of Patent: Mar. 3, 1987

[54] YARN TRAVERSING APPARATUS

[75] Inventors: Heinz Schippers, Remscheid; Herbert Schiminski, Hückeswagen; Herbert Turk, Remscheid; Klaus Mayer, Remscheid; Hans-Jochen Busch, Remscheid, all of Fed. Rep. of Germany

[73] Assignee: Barmag Barmer Maschinenfabrik Aktiengesellschaft, Remscheid, Fed. Rep. of Germany

[21] Appl. No.: 839,884

[22] Filed: Mar. 14, 1986

[30] Foreign Application Priority Data

Mar. 15, 1985 [DE] Fed. Rep. of Germany ..... 3509312

[51] Int. Cl.[4] ..... B65H 54/28

[52] U.S. Cl. ..... 242/43 A

[58] Field of Search ..... 242/43 A, 43 R, 43.1, 242/158 R, 158 B

[56] References Cited

U.S. PATENT DOCUMENTS

| | | | |
|---|---|---|---|
| 3,362,652 | 1/1968 | Butterworth | 242/43 A |
| 3,374,961 | 3/1968 | Otsuka et al. | 242/43 A |
| 3,650,486 | 3/1972 | Hasegawa et al. | 242/43 A |
| 4,505,436 | 3/1985 | Schippers et al. | 242/43 A |
| 4,505,437 | 3/1985 | Schippers et al. | 242/43 A |

*Primary Examiner*—Stanley N. Gilreath

*Attorney, Agent, or Firm*—Bell, Seltzer, Park & Gibson

[57] ABSTRACT

A yarn traversing apparatus is disclosed, which is adapted for use in winding a running yarn to form a cross wound package. The traversing apparatus includes a yarn guide bar, and a pair of oppositely rotating rotors, and the rotors include radiating arms which define two closely adjacent planes of rotation. The rotors are mounted for rotation about offset axes, so that the arms sweep across the guide bar in opposite directions to define the yarn traverse stroke. The rotors are rotatably driven by a gear drive system which includes a transmission shaft, and the transmission shaft and one of the rotors are mounted in eccentric bushings which permit the meshing gears to be adjusted so as to eliminate backlash.

9 Claims, 5 Drawing Figures

YARN TRAVERSING APPARATUS

The present invention relates to a yarn traversing apparatus adapted for use in winding a cross wound package.

U.S. Pat. Nos. 4,505,436 and 4,505,437 each disclose a yarn winding apparatus comprising a plurality of side by side traversing assemblies extending along the length of a package support spindle, with each traversing assembly comprising a yarn guide bar and a pair of oppositely rotating rotors. The rotors include radially directed arms which define two closely adjacent planes of rotation, and the two rotors of each assembly are mounted for rotation about offset axes and so that the arms sweep across the guide bar in opposite directions to define the yarn traverse stroke.

In traversing assemblies of the described type, it is important that the angular velocity of the two rotors, as well as the angular positioning of the arms of the rotors, be accurately maintained, so as to insure a reliable transfer of the yarn at the stroke reversal points. Also, even when the rotors are accurately adjusted with respect to their axes, problems with a nonuniform package build are often observed, in particular when fine yarns and man made filament yarns are being wound.

It is accordingly an object of the present invention to provide a yarn traversing apparatus which provides for a reliable transfer of the yarn at the stroke reversal points, and which avoids the above-noted problems associated with a nonuniform package build.

These and other objects and advantages of the present invention are achieved in the embodiment illustrated herein by the provision of a traversing apparatus which comprises a supporting casing, a first rotor including a tubular shaft, and at least two radiating arms and a first gear mounted to the tubular shaft, a second rotor including a central shaft, and at least two radiating arms and a second gear mounted to the central shaft, and a transmission shaft having a gear mounted to each of the ends thereof. Means are provided for rotatably mounting each of the first rotor, the second rotor, and the transmission shaft to the supporting casing for rotation about parallel axes, with one of the gears of the transmission shaft meshing with the first gear of the first rotor, and the other of the gears of the transmission shaft meshing with the second gear of the second rotor. Also, the mounting means includes first adjustment means for adjusting the lateral separation between the axis of the transmission shaft and the axis of the first rotor, and second adjustment means for adjusting the lateral separation between the axis of the second rotor and the axis of the transmission shaft, such that the backlash between the meshing gears may be effectively eliminated.

Preferably, the first adjustment means comprises a first bushing eccentrically receiving the transmission shaft therethrough, with the first bushing be rotatably mounted to the casing, and such that rotation of the first bushing causes lateral movement of the axis of the transmission shaft. In addition, the second adjustment means preferably comprises a second bushing eccentrically receiving said central shaft of said second rotor therethrough, with the second bushing being rotatably mounted to the casing and such that rotation of the second bushing causes lateral movement of the axis of the second rotor.

Thus in accordance with the present invention, it has been discovered that a backlash in the gear connections of the two rotors and the transmission shaft leads to the above noted problems associated with nonuniform packages, and that the backlash may be eliminated by mounting one of the rotors and the transmission shaft in eccentric bushings, and by rotatably mounting the bushings in the supporting casing to permit relative adjustment of the respective axes.

Each of the rotors includes at least two radiating arms which sweep across a fixed yarn guide bar, and the radiating arms are preferably removably attached to the associated shafts of the rotors. This facilitates the alignment procedure of the rotors, which involves first laterally adjusting the axes of the two rotors with respect to the axis of the transmission shaft, and then mounting the radiating arms to their associated shafts so that they are in a precisely defined angular relationship.

The adjustment of the backlash of the gear connections is further facilitated by providing for an unequal eccentricity in the two bushings. In particular, it is preferable that the eccentricities have a ratio of one to two. This relationship permits the lateral displacement of one shaft, which is produced by the rotation of its eccentric bushing, while assuring that the displacement of the other shaft can match the original displacement and still be further displaced to achieve a proper meshing of the associated gears. It is also preferred that the supporting casing be adjustably mounted to the frame of the winding machine, to permit rotation of the supporting casing about a central axis thereof, and so that the axes of the rotors can be accurately aligned with the fixed yarn guide bar and then locked in place.

Some of the objects and advantages of the present invention having been stated, others will appear as the description proceeds, when taken in connection with the accompanying generally schematic drawings, in which FIG. 1 is a fragmentary top plan view illustrating the rotors and guide bar of a yarn traversing apparatus which embodies the features of the present invention;

Figure 2:
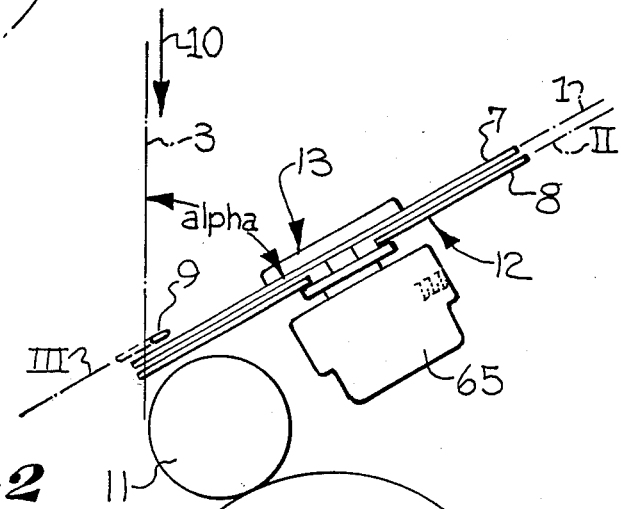
FIG. 2 is a sectional end view of a yarn winding apparatus, and which illustrates additional components of the yarn traversing assembly of the present invention.
Figure 3:
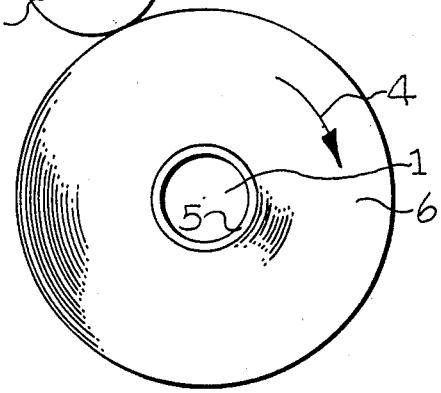
FIG. 3 is a sectional side elevation view of the yarn traversing apparatus.
Figure 3:
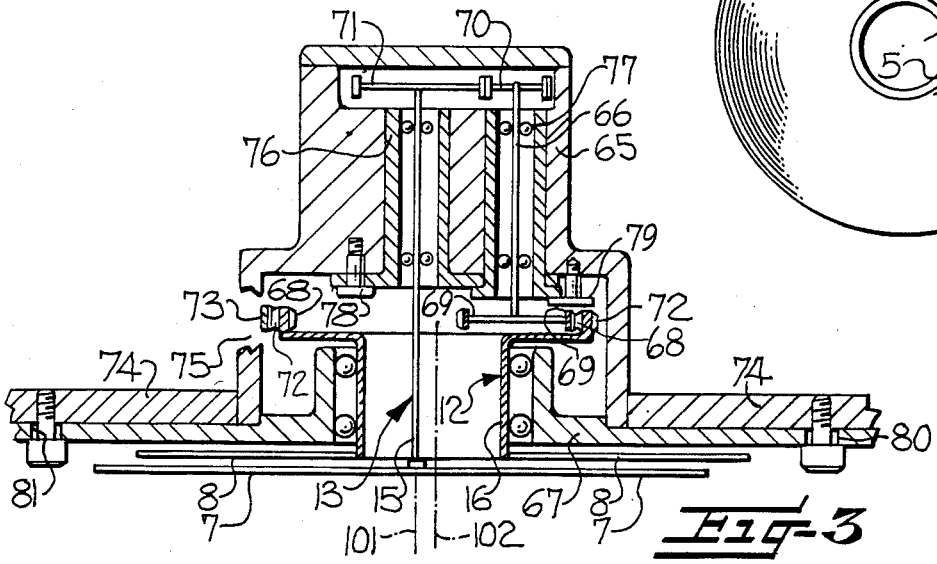
Figure 4:
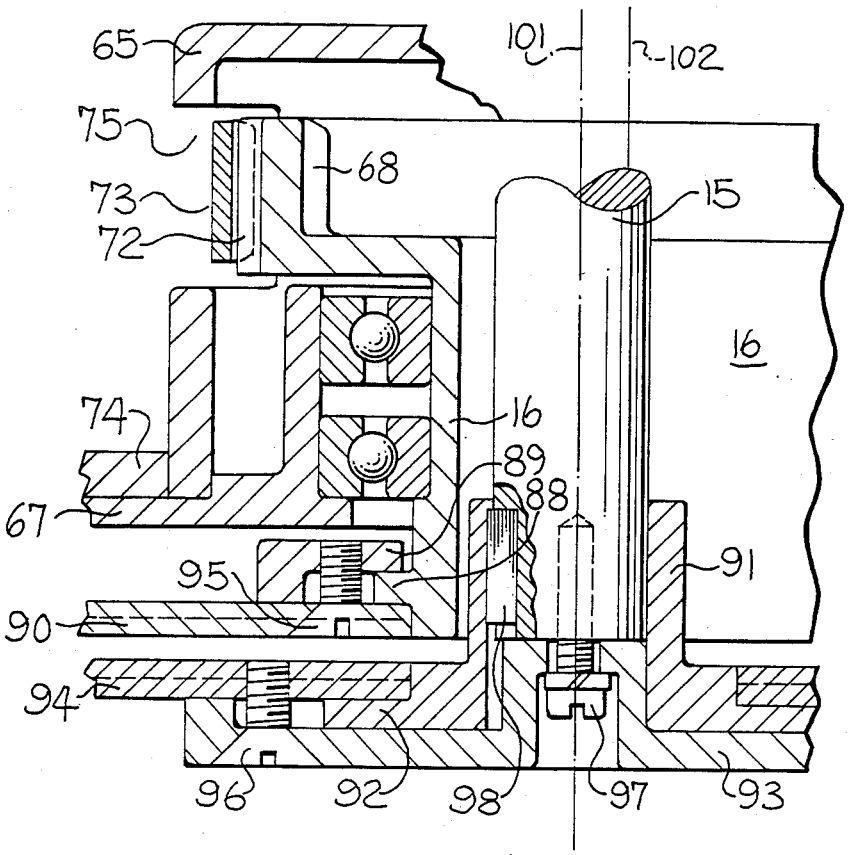
FIG. 4 is a fragmentary and more detailed view of a portion of FIG. 3.

Referring more particularly to the drawings, FIG. 2 illustrates a portion of a yarn winding apparatus embodying the features of the present invention, and which is adapted for winding a plurality of running yarns 3 into cross wound packages 6. The apparatus comprises a support spindle 1 for mounting a plurality of tubular bobbins 5, and a separate yarn traversing apparatus 2 is provided for reciprocating each of the running yarns 3 and so as to form a wound yarn package 6 on each of the tubular bobbins 5. The support spindle 1 is driven in the rotational direction 4 by a motor (not shown) which is operatively connected to the spindle. As illustrated in the above cited U.S. patents, the spindle 1 typically mounts three to eight tubular bobbins 5 in a coaxial arrangement, and a like number of yarns 3 may be advanced parallel to each other to form a like number of packages 6.

Each yarn traversing apparatus 2 comprises a supporting casing 65, a first rotor 12 having a tubular shaft 16 and three coplanar radial arms 8 fixed to the shaft and radiating therefrom. Also, there is provided a second rotor 13 having a central shaft 15 and three coplanar radial arms 7 radiating therefrom. The arms 7 and 8 are arranged in two rotary planes I and II. Further, there is provided a yarn guide bar 9 which is fixedly mounted to the frame 74 of the machine, and which extends in a direction generally parallel to the axis of the supporting spindle 1 and immediately upstream of the rotary arms 7 and 8 so as to lie in a plane III which is parallel to the planes I and II. As described in more detail in the above cited U.S. patents, the two rotors 12, 13 define a traverse stroke H, which extends along the length of the guide bar 9, and the traverse stroke H covers a sector angle of about 60°. It should also be noted that the yarn guide bar 9 may be located on the opposite side of the yarn path from the rotors, as shown in dashed lines in FIG. 1.

The planes I, II, and III, are inclined so that the planes form an angle with the direction of the advancing yarn, indicated by the arrow 10, at an angle alpha of between about 45° to 70°. As a result, a guide roll 11 can be accommodated at a very small distance below the rotary plane II, and the yarn contacts the guide roll 11 as it is conducted to the package 6. As illustrated, the guide roll 11 is in circumferential contact with the package 6, but it may alternatively be spaced a small distance from the package surface and be separately driven.

An accurate package build requires first that the relative phase relationship of the rotors be precisely maintained so that the arms 7 and 8, which perform the traversing movements of the yarn, always meet at the ends of the stroke H. As is known, a precise transfer of the yarn at the stroke reversal points is an essential criterion for preventing the cylindrical packages from having enlarged ends as they are formed. Secondly, the accurate functioning of the yarn traversing apparatus depends on a precise alignment of the two rotors with respect to the guide bar 9, which also influences the precise transfer of the yarn. As will become apparent, the yarn transfer apparatus of the present invention is adapted to provide these requirements.

In accordance with the present invention, the traversing assembly 2 is housed in a supporting casing 65, which is removably mounted to the frame member 74 of the winding machine by bolts. The casing 65, when viewed in plan, may be round, or oval or elliptical, with the primary axis extending in the direction of the eccentricity e between the hollow shaft 16 and central shaft 15 as further described below. The shaft 15 of the rotor is rotatably mounted in the casing 65 for rotation about the axis 101, and the casing cover 67 rotatably mounts the tubular shaft 16 of the rotor for rotation about the axis 102. The cover 67 and the casing 65 are fixedly connected to each other by bolts or the like (not shown). The tubular shaft 16 is provided with an internal gear 68, and the outside surface of the shaft 16 includes an external gear 72 for engagement with a toothed wheel or toothed belt. As illustrated, the tubular shaft 16 is driven by a belt 73 which engages the gear 72, and the casing 65 is provided with an appropriate opening 75 to permit the belt to pass therethrough. The rotational movement of the tubular shaft 16 is transmitted to the shaft 15 via a transmission shaft 66, which is also rotatably mounted in the casing 65, and such that the axes of the shaft 16, shaft 15, and transmission shaft 66 are all parallel. In addition, the shaft 15 of the second rotor 13 extends through the tubular shaft 16 of the first rotor 12, but the axes 101, 102 thereof are laterally offset by the eccentricity e. Also, the transmission shaft includes a gear 69 operatively engaging the internal gear 68 of the shaft 16, and a gear 70 which operatively engages with the mating gear 71 on the shaft 15. Thus rotation imparted to the first rotor 12 by the drive belt 73 is transmitted to the shaft 15 of the second rotor, so that the two rotors rotate about their respective axes in opposite directions.

The shaft 15 is mounted in an eccentric bushing 76, and the transmission shaft 66 is mounted in an eccentric bushing 77. The outside cylindrical surfaces of each of these eccentric bushings is eccentric with respect to the inside bore. The eccentricity is on the order of about 0.5 mm, with the eccentricity of the bushing 76 preferably being about twice of the eccentricity of the bushing 77. This arrangement facilitates assembly and adjustment, in that the casing is normally first mounted to the frame member 74 without the arms 7 and 8. The eccentric bushing 77 is then rotated, by inserting a special tool through the opening 75, and so as to eliminate the backlash between the internal gear 68 of the tubular shaft 16, and the gear 69 on the transmission shaft 66. This initial adjustment may increase the backlash between the gears 70 and 71, and to eliminate this backlash, the eccentric bushing 76 is then rotated, again by a tool extending through the opening 75, to thereby eliminate any backlash between the gears 70, 71, i.e. between the transmission shaft 66 and shaft 15 of the rotor. Locking bolts 78, 79 are also provided, by which the eccentric bushings 76, 77 are secured to the casing in a selected rotational position. After these adjustments, the traversing assembly will operate free of play or backlash.

Figure 1:
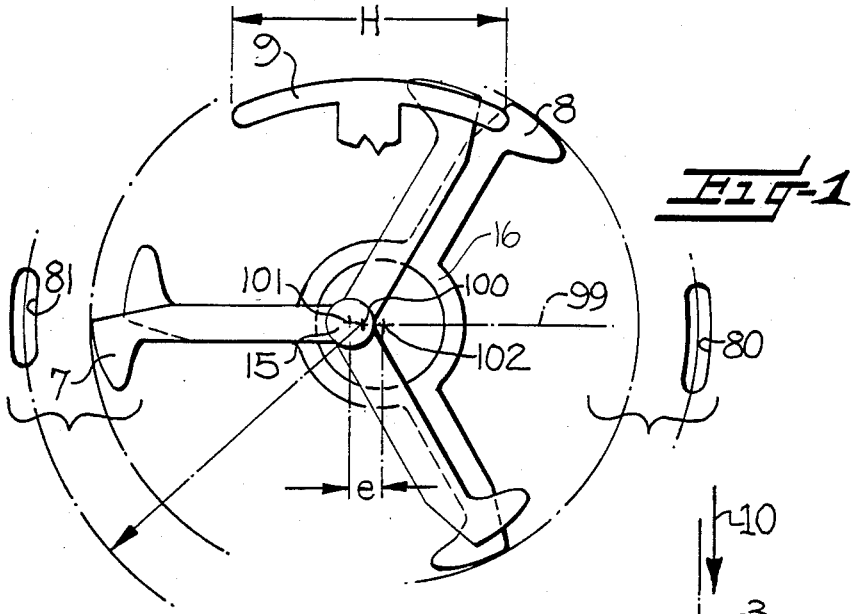

The rotors are mounted in the casing in a predetermined phase relationship, and to align the rotors with the guide bar 9, oblong openings 80, 81 are provided in the cover 67 for the mounting bolts. As best seen in FIG. 1, the oblong openings 80, 81 define a circle having its center at point 100, which lies midway between the axes 101, 102 and on a line 99 which extends directly between the axes 101, 102. This permits the casing 65 to be mounted to the frame 74 of the winding apparatus, such that the casing is rotatable about an axis extending through the point 100, and such that the line 99 may be aligned so as to be precisely parallel to a line extending between the end points of the guide bar 9. In this regard, it will be understood that this connecting line 99 between the axes of the shafts 15 and 16 will change upon rotation of the eccentric bushings 76 and 77.

Figure 5:
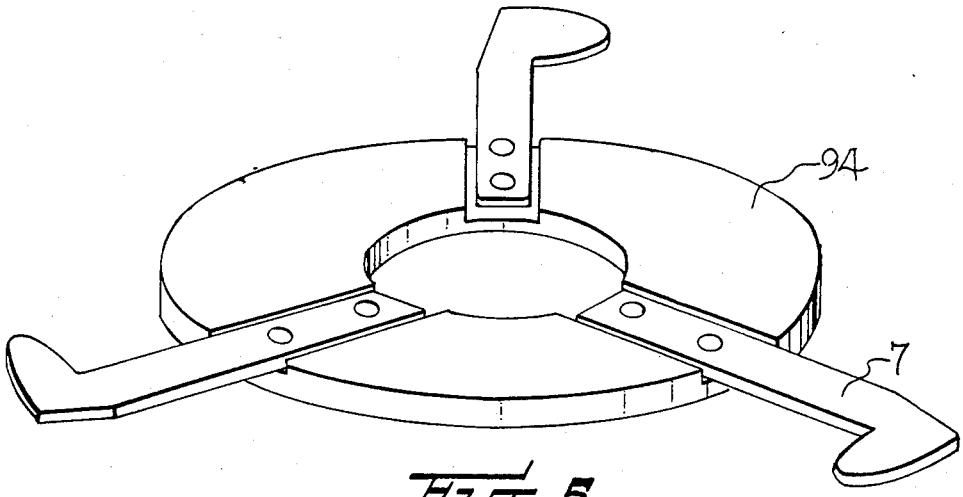
FIG. 5 is a perspective view of the arms and mounting arrangement for the arms of one of the rotors of the present invention.

FIG. 5 illustrates a preferred embodiment for releasably and adjustably mounting the radial arms 7 to the central shaft 15 of the rotor 13. In particular, the arms 7 are mounted to a disc 94, and the disc 94 includes radial grooves having a depth which corresponds to the thickness of the arms, and a width which is somewhat wider than that of the arms. The arms are glued to the disc, utilizing a suitable tool or jig which maintains the exact tolerance of the relative angular position of the arms, and in such a way that their angular separation is exactly 120°. Bolts or screws may be provided for improving the security of the interconnection between the arms and the disc.

The radial arms 8 to be mounted to the tubular shaft 16 of the rotor 12 are mounted to a disc 90, which corresponds exactly to the disc 94, with the exception that the disc 90 is oriented to face oppositely from the disc 94. Thus the radial arms 8 which are mounted to the disc 90 are directly opposed to the arms 7 mounted on the disc 94. The radial arms 8 are mounted to the disc 90 in the same manner as described above with respect to the disc 94.

During assembly of the yarn traversing apparatus, the radial arms 7 and 8 are first mounted to their respective discs 94, 90. Thereafter, the disc 90 is mounted to the tubular shaft 16, and for this purpose, the shaft 16 includes an integral annular flange 88. An annular bracket 89 is concentrically positioned on the tubular shaft 16 on one side of the annular flange 88, and the disc 90 is secured to the annular bracket 89 by means of threaded members 95, so that the annular flange 88 is clamped therebetween. By this arrangement, the disc 90 can be released and rotated with respect to the tubular shaft 16, and it may then be fixed to the shaft 16 so as to maintain a given rotational position.

The disc 94 and arms 7 may then be mounted to the central shaft 15 of the rotor 13. For this purpose, a bushing 91 is provided which is fixed to the shaft 15 by means of a key 98. The bushing includes an annular flange 92 for concentrically receiving the disc 94 in such a way that the arms mounted to the discs 90 and 94 directly face each other. A mounting plate 93 is fixed to the end of the shaft 15 by means of a bolt 97, and the disc 94 and mounting plate 93 are interconnected by means of threaded members 96 which engage threaded holes in the disc 94. The disc 94 and mounting plate 93 thereby axially clamp the annular flange 92 therebetween. By releasing the threaded members 96, the disc 94 and mounting plate 93 may be rotated with respect to the bushing 91 and the shaft 15, so that a desired angular relationship may be exactly established. By tightening the threaded members 96, the disc 94 will be fixedly mounted to the shaft 15 in the given angular relationship.

By rotating the discs 90 and 94, and adjusting their rotational position with respect to each other, the arms 7 mounted to the shaft 15 and the arms 8 mounted to the tubular shaft 16 may be brought into a position which insures that the yarn is properly transferred from one of the arms 7 to one of the arms 8, and vice versa.

In the drawings and specification, there has been set forth a preferred embodiment of the invention, and although specific terms are employed, they are used in a generic and descriptive sense only and not for purposes of limitation.

That which is claimed is:

1. A yarn traversing apparatus adapted for use in winding a running yarn to form a cross wound package, and comprising a supporting casing, a first rotor including a tubular shaft, at least two coplanar radial arms radiating from said tubular shaft, and a first gear mounted coaxially to said tubular shaft, a second rotor including a central shaft, at least two coplanar radial arms radiating from said central shaft, and a second gear coaxially mounted to said central shaft, a transmission shaft having a gear mounted to each of the ends thereof, and means rotatably mounting each of said first rotor, said second rotor, and said transmission shaft to said supporting casing for rotation about parallel axes, with one of said gears of said transmission shaft meshing with said first gear and the other of said gears of said transmission shaft meshing with said second gear, and including first adjustment means for adjusting the lateral separation between the axis of said transmission shaft and the axis of said first rotor, and second adjustment means for adjusting the lateral separation between the axis of said second rotor and the axis of said transmission shaft, and such that the backlash between the mating gears may be effectively eliminated.

2. The yarn traversing apparatus as defined in claim 1 wherein said first adjustment means comprises a first bushing eccentrically receiving said transmission shaft therethrough, with said first bushing being rotatably mounted to said casing, and such that rotation of said first bushing causes lateral movement of the axis of said transmission shaft with respect to the axis of said first rotor.

3. The yarn traversing apparatus as defined in claim 2 wherein said second adjustment means comprises a second bushing eccentrically receiving said central shaft of said second rotor therethrough, with said second bushing being rotatably mounted to said casing, and such that rotation of said second bushing causes lateral movement of the axis of said second rotor with respect to the axis of said transmission shaft.

4. The yarn traversing apparatus as defined in claim 3 further comprising means for releasably locking each of said first and second bushings to said casing to preclude rotation thereof with respect to said casing.

5. The yarn traversing apparatus as defined in claim 4 wherein said central shaft of said second rotor extends within said tubular shaft of said first rotor, and the axes of the central shaft and tubular shaft are laterally offset.

6. The yarn traversing apparatus as defined in claim 5 further comprising means adjustably mounting said supporting casing to a frame member of a winding machine or the like, so as to permit rotation of said casing about the axis of said tubular shaft, and including means for locking said supporting casing to said frame member in a selected relative position.

7. The yarn traversing apparatus as defined in claim 6 further comprising a yarn guide bar fixedly mounted with respect to said frame member and extending in a direction generally parallel to a line extending perpendicularly between the axes of said central shaft and tubular shaft, and whereby said means adjustably mounting said supporting casing to said frame member permits said line to be accurately aligned with said guide bar.

8. The yarn traversing apparatus as defined in claim 1 further comprising means releasably mounting said arms of each of said first and second rotors to its associated shaft.

9. The yarn traversing apparatus as defined in claim 8 wherein said means releasably mounting said arms to each of said first and second rotors to its associated shaft includes a disc mounting the associated arms in a predetermined angular relationship, and means mounting said disc to the associated shaft so as to permit angular adjustment between the disc and associated shaft, and whereby the relative angular position of the arms and their associated shaft may be adjusted.

* * * * *